US005379695A

United States Patent [19]

Rieth et al.

[11] Patent Number: 5,379,695

[45] Date of Patent: Jan. 10, 1995

[54] APPARATUS AND METHOD FOR REMOVING CONTAMINANTS FROM ROLLERS

[75] Inventors: John E. Rieth, Penfield; Theodore R. Czlonka, Jr., Spencerport, both of N.Y.

[73] Assignee: Eastman Kodak Company, Rochester, N.Y.

[21] Appl. No.: 69,065

[22] Filed: May 28, 1993

[51] Int. Cl.[6] ..... B41F 35/00

[52] U.S. Cl. ..... 101/424; 101/425

[58] Field of Search ..... 101/424, 423, 425; 15/256.53, 256.52, 256.51, 256.50

[56] References Cited

U.S. PATENT DOCUMENTS

| | | | |
|---|---|---|---|
| 3,913,797 | 10/1975 | Brym | 101/336 |
| 4,019,217 | 4/1977 | Schinke | 15/256.23 |
| 5,138,945 | 8/1992 | Lee et al. | 101/425 |
| 5,213,040 | 5/1993 | Mihori et al. | 101/424 |

FOREIGN PATENT DOCUMENTS

| | | | |
|---|---|---|---|
| 2528261 | 5/1976 | Germany | 101/425 |

*Primary Examiner*—Edgar S. Burr
*Assistant Examiner*—Anthony H. Nguyen
*Attorney, Agent, or Firm*—Clyde E. Bailey

[57] ABSTRACT

An apparatus 10 and method for removing contaminants from a web conveying roller 12 in a machine enclosure 14 comprises a cleaning head 16 that is manually operably controlled external to the machine enclosure 14 so as to resist introducing foreign contaminants into the machine enclosure 14 and reduce environmental emissions. The cleaning head 16 slidably moves lengthwise along the roller to a predetermined location under the influence of first rotatable shaft 30 and is urged into contact with the roller 12 and retracted therefrom under the influence of second rotatable shaft 40.

10 Claims, 4 Drawing Sheets

APPARATUS AND METHOD FOR REMOVING CONTAMINANTS FROM ROLLERS

FIELD OF THE INVENTION

The invention relates to an apparatus and method for removing contaminants from a roller in web fabrication and coating equipment. More particularly, the invention concerns an apparatus that traverses the roller and contacts a preselected position to be cleaned during the manufacturing of photosensitive web material.

BACKGROUND OF THE INVENTION

Conventional apparatus for removing foreign matter from rollers in web manufacturing equipment uses a cleaning rod that is periodically inserted into the machine through an opening and then moved along the side of the roller to a predetermined location. The rod is then manually urged into contact with the surface of the roller for removal of foreign matter. After removing particles or contaminants from the roller, the cleaning rod is removed from the machine until another use is indicated by the operator.

In the manufacture of acetate film base, a liquid dope generally comprising various solvents, such as methylene chloride and methyl alcohol, is cast onto a polished surface and then stripped away in order to further cure the film base prior to winding the film into roll form. While the film is curing it is placed inside a machine enclosure in order to protect the film from outside contaminants which are known to have deleterious effects on the web during manufacturing. More importantly, the machine enclosure both limits operator exposure to solvent emissions and reduces overall environmental emissions. Cleaning the rollers is required because contaminants are known to migrate onto the roller and adhere to the surface. Hence each revolution of the roller results in an imperfection, such as impressions, to the conveyed web which makes the web unsuitable for use.

The prior art apparatus for cleaning rollers in such machine enclosures invariably presents contaminants into the machine enclosure because the cleaning mechanism is staged outside the machine enclosure in generally ambient air and then inserted into the machine enclosure for a typical cleaning operation. In this manner, contaminants are transported into the machine enclosure by the cleaning apparatus thereby reducing the effectiveness of the cleaning operation. Moreover, the prior art apparatus does not provide means for preventing operator exposure to emissions and overall environmental emissions.

In the printing press field, although not related to web fabrication, a device is described in U.S. Pat. No. 5,138,945 to Lee for removing foreign particles from the image area of rotating plate cylinders. The Lee '945 device uses a wiper blade that rides on a lead screw inside the printing machine during operations. The wiper blade is projected into engagement with a rotating plate cylinder to remove foreign particles from a predetermined position on the plate cylinder. Shortcomings of the Lee '945 patent for solving the problems faced by the inventor are that the wiper blade apparatus is unduly complex, costly to manufacture and would damage the sensitive web conveying rollers. Furthermore, it would be undesirable to use the wiper blade apparatus of Lee because the wiper blade serves as a host for collecting and releasing foreign particles which could potentially recontaminate the sensitive web conveyance rollers, thus defeating the cleaning operation.

Therefore, there persists a need for an apparatus for cleaning a roller inside a machine enclosure that is inexpensive to manufacture, does not release or generate contaminants in the machine enclosure, and is easily operable manually outside the machine enclosure thereby resisting the introduction of contaminants into the machine enclosure and reducing environmental emissions.

SUMMARY OF THE INVENTION

The present invention is defined by the claims and is directed to overcoming one or more of the problems set forth above. Briefly summarized, according to one aspect of the present invention, an apparatus for removing contaminants from a roller inside a machine enclosure, comprises a cleaning head, means for moving the cleaning head lengthwise along the roller, means for urging the cleaning head into contact with a predetermined location on the roller and retracting the cleaning head therefrom, and means external to the machine enclosure for manually operably controlling both the moving means and the urging and retracting means so as to resist introducing foreign contaminants into the enclosure and reducing environmental emissions.

According to another aspect of the invention, the apparatus above has a means for applying a cleaning solution to the cleaning head.

Moreover, in another aspect of the invention, a method for removing contaminants from a roller comprises providing a cleaning head as described above, slidably moving the cleaning head lengthwise along the roller to a predetermined location, urging the cleaning head into contact with the roller at the predetermined location, retracting the cleaning head from the roller, and wherein the slidably moving, urging and retracting steps are manually operably controlled external to the machine enclosure so as to resist introducing contaminants inside the enclosure and reduce environmental emissions.

These and other aspects, objects, features and advantages of the present invention will be more clearly understood and appreciated from a review of the following detailed description of the preferred embodiments and appended claims, and reference to the accompanying drawings.

DETAILED DESCRIPTION OF THE DRAWINGS

Figure 1:
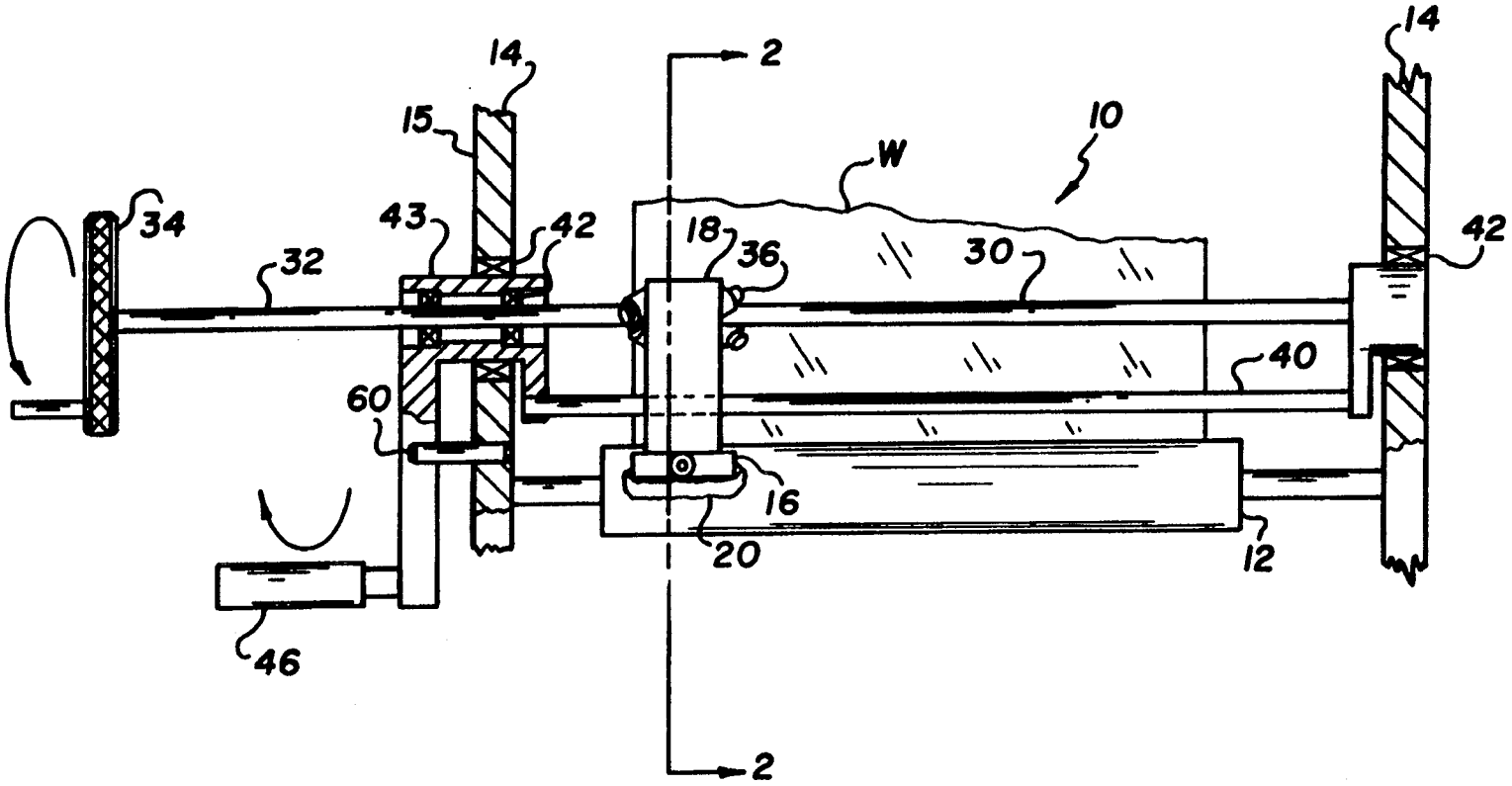
FIG. 1 is a front elevation view of the preferred embodiment of the apparatus in accordance with the principles of the invention.
Figure 2:
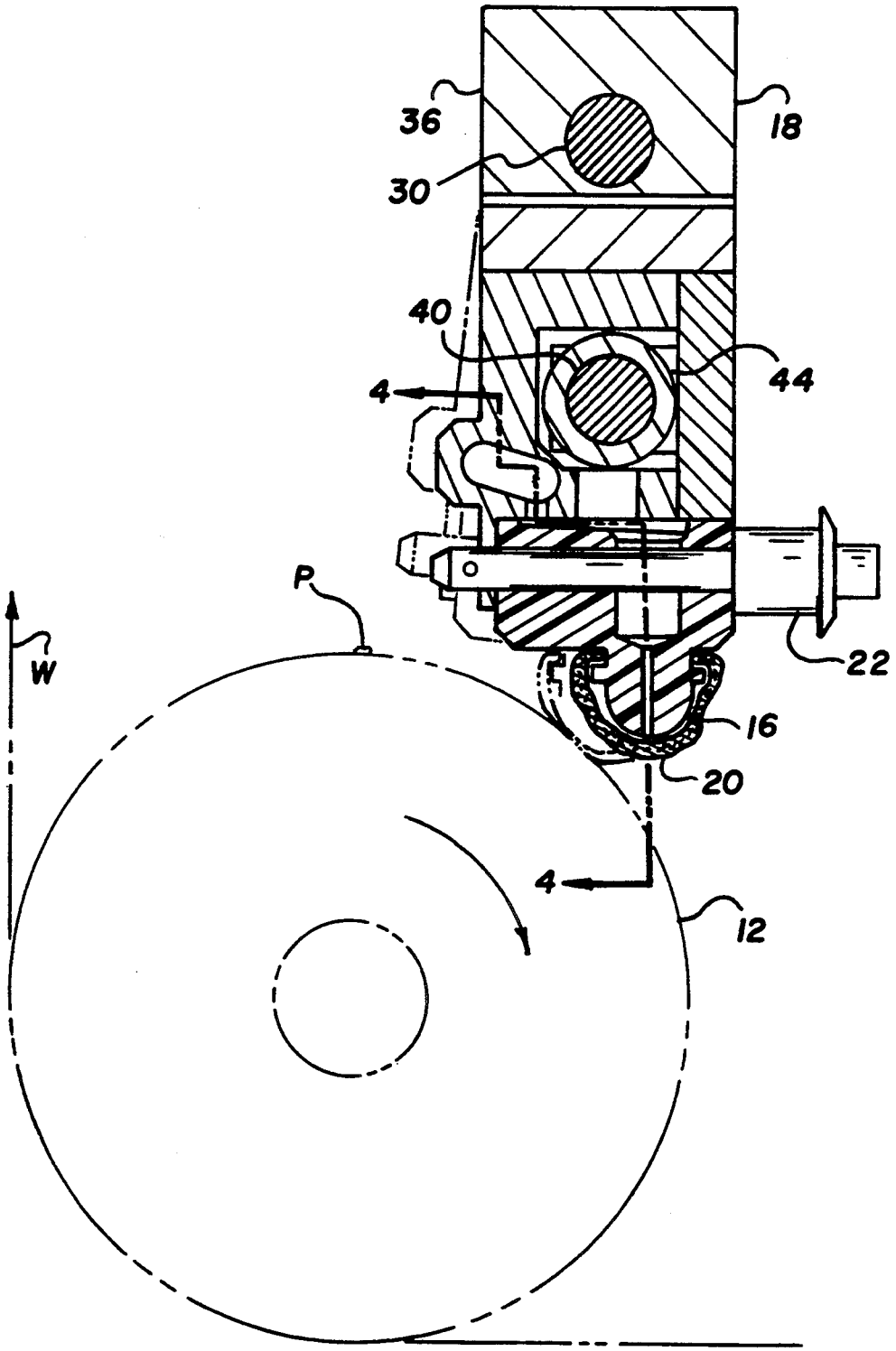
FIG. 2 is a cross sectional view taken along line 2—2 of FIG. 1.
Figure 3:
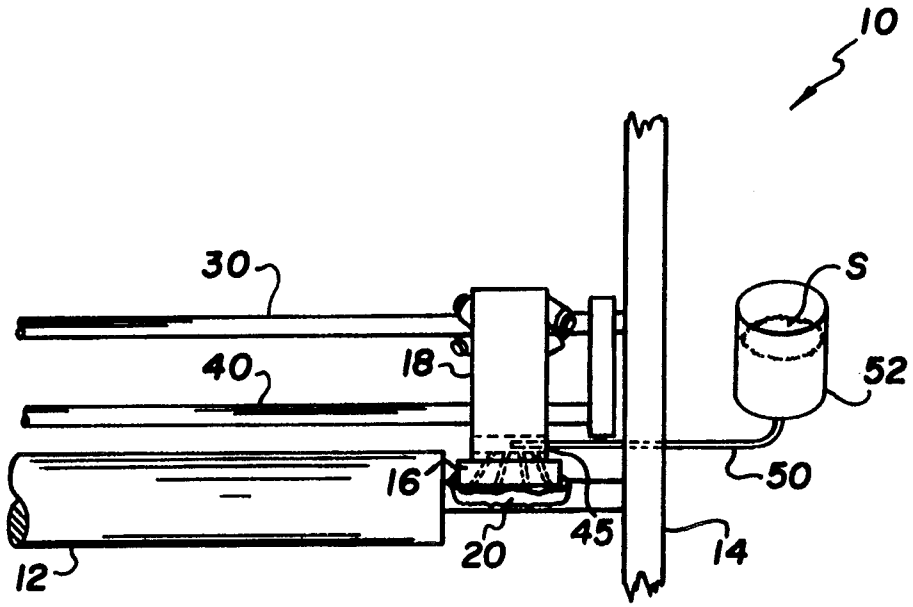
FIG. 3 is a fragmentary front elevation of an alternative embodiment of the invention showing a cleaning solution member; and, FIG. 4 is a section view taken along the 4—4 line of FIG. 2.

Referring to FIGS. 1–3, an apparatus 10 for removing contaminants from a roller 12 inside a machine enclosure 14 containing solvents, such as methylene chloride, methyl alcohol and mixtures thereof, comprises a cleaning head 16 and manually operable control means (described below) positioned exterior to the machine enclosure 14. The cleaning head 16 is slidably movable lengthwise along the roller 12 to a preselected position where foreign particles are known to be located. Precise location of roller 12 contaminants is determined by measuring the distance along the cured web (w) where a defect or series of defects appear and then visually monitoring the movement of cleaning head 16 toward the location on the roller 12 by peering through a window (not shown) in the machine enclosure 14. The cleaning head 16 is provided with manually operable means (as further described below) for urging it into cleaning contact with the roller 12 at the precise location of the contaminant. To resist damaging the roller 12 on contact, cleaning head 16 is provided with an absorbent material 20, preferably a substantially lint-free cotton. Other soft, substantially lint free fibers may be used, such as felt.

In an alternative embodiment, cleaning head 16 is mounted for movement in a cleaning housing 18 and secured to the cleaning housing 18 preferably with a removable locking pin 22 (shown clearly in FIG. 2). One skilled in the art will appreciate that other securing means may be used, such as clamps or screws. Cleaning housing 18 provides the advantage of enabling additional optional operations to be incorporated into the cleaning operation, such as means for receiving and channeling cleaning solution to the cleaning head 16, as described below.

Preferably, means for slidably moving the cleaning head 16 lengthwise along the roller 12 comprise a first rotatable shaft 30 positionable inside the machine enclosure 14. First shaft 30 is preferably smooth so that the cleaning head 16 can smoothly traverse the shaft 30. Additionally, smooth shaft 30 has the advantage of not generating contaminants in the manner that the spindle screw does in the cleaning system taught by Lee '495. First shaft 30, moreover, has an end portion 32 extending outside the machine enclosure 14, the end portion 32 having a rotatable hand crank 34 for rotating the shaft 30 (FIG. 1). Those skilled in the art will appreciate that there are other means for manually rotating the shaft 30 within the definition of the invention, such as with a knob attached to end portion 32 (not shown). In the preferred embodiment, the cleaning head 16 is mounted for slidable movement on the smooth shaft 30. A linear actuator 36 supports cleaning head 16 and is mounted on shaft 30 to enable cleaning head 16 to ride smoothly along the shaft 30. Linear actuator 36 comprises a series of ball bearings mounted around and at an angle (or skewed) to shaft 30 so that rotation of shaft 30 causes linear motion of actuator 36 and cleaning head 16 along the shaft 30 (FIG. 1). More particularly, linear actuator 36 causes cleaning head 16 to slidably move smoothly in one direction in response to a clockwise rotation of the shaft 30; and rotation of shaft 30 in a counterclockwise direction causes the cleaning head 16 to slidably move smoothly in the opposite direction. A preferred linear actuator 36 is a Roh-Lix Actuator made by Zero-Max Corp. of Minneapolis, Minn.

Means for urging the cleaning head 16 into contact with the web conveying roller 12 and retracting the cleaning head 16 therefrom comprise a second shaft 40 positioned inside the machine enclosure 14 and mounted for movement about the first shaft 32 by a concentric bearing arrangement 42 (FIG. 1). Those skilled in the art will appreciate that other means of rotatably mounting shaft 40 may include providing an arcuate channel (not shown) in side wall 15 in which the movement of shaft 40 along the channel causes cleaning head 16 to pivot away from roller 12 or conversely pivots towards roller 12. The second shaft 40 has an end portion 43 extending outside the machine enclosure 14. End portion 43 comprises a hand crank 46 which when rotated clockwise urges the cleaning head 16 into contact with the roller 12 and retracts the cleaning head 16 therefrom when rotated in the counterclockwise direction. The cleaning head 16 comprises a guide bushing 44 through which the second shaft 40 slides when the cleaning head 16 is traversing the roller 12 (shown clearly in FIG. 2). A preferred guide bushing 44 is one made of Rulon® made by Dixon Valve & Coupling Co., 800 High Street, Chestertown, Md.

Figure 4:
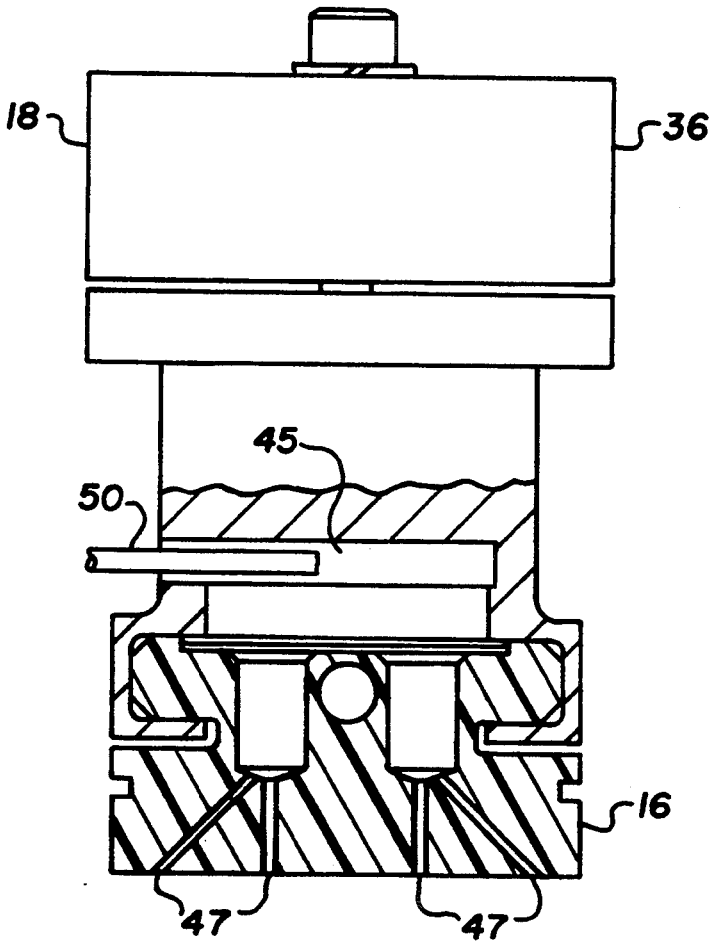

FIG. 3 shows an alternative embodiment of the invention comprising means for applying a cleaning solution (s) to the cleaning head 16. Preferably, cleaning solution (s) is supplied from a reservoir 52 positioned outside the machine enclosure 14. The solution (s) is fed through a conduit 50 in fluid communication with the reservoir 52 and into a fluid channel 45 in the cleaning housing 18. Solution (s) in fluid channel 45 then flows along a predetermined flow path 47 in fluid communication with flow channel 45 to the cleaning head 16, as shown clearly in FIG. 4. Fluid flow path 47, therefore, terminates at the cleaning head 16 thereby providing a moist absorbent layer 20 for removing particles (p) from roller 12. Alternatively, those skilled in the art will appreciate that the cleaning solution may also be sprayed onto the cleaning head 16 (not shown). The cleaning solutions which are most effective in cleaning the rollers 12 include methylene chloride, methyl alcohol and mixtures thereof.

In another aspect of the invention, a method for removing contaminants from a web conveying roller 12 inside a machine enclosure 14 comprises the steps of providing a cleaning head 16, as described above, slidably moving the cleaning head 16 lengthwise along the roller 12 to a predetermined location along the roller 12, urging the cleaning head 16 into contact with the roller 12, and retracting the cleaning head 16 away from the roller 12 after the contaminant has been removed. In this embodiment, the slidably moving, urging and retracting steps are manually operably controlled external to the machine enclosure 14 so as to resist introducing contaminants inside the enclosure 14 and to contain the solvent emissions, as discussed above. In an alternative embodiment, the method further may include applying a cleaning solution (s), as described above, to the cleaning head 16 before the cleaning head 16 is moved into contact with the web conveying roller 12.

Accordingly, to remove contaminants from roller 12, the operator, without exposing himself to emissions and introducing contaminants into the machine enclosure 14, peers through a window (not shown) on the machine enclosure 14 and manually maneuvers the cleaning head 16 to a predetermined position beyond the end of roller 12 where a cleaning solution (s) can be applied, as previously described. The operator then moves the cleaning head 16 to a cleaning position lengthwise along the web conveying roller 12 where a particle (p) resides by rotating the first shaft 30 in a counterclockwise direction, as illustrated in FIG. 2. At this point, the cleaning head 16 is spaced from the roller 12 and must be urged into contact with the roller 12 by rotating the second shaft 40 in a clockwise direction. The pressure of the cleaning head 16 applied to the roller 12 is within the control of the operator but, will of course, not exceed an amount resulting in damage to the roller 12 or the cleaning head 16. Those skilled in the art will appreciate that a pivot stop 60 mounted for rotational interference with crank 46 on exterior wall 15 of enclosure 14, may be used to prevent the cleaning head 16 from contacting the roller in a manner that would damage it (FIG. 1). Once the contaminant has been removed, the operator simply rotates the second shaft 40 counterclockwise to retract the cleaning head 16 away from the roller 12 to a non-interfering rest position. The cleaning head 16 can be adapted to continuously clean the roller 12 by simply allowing the cleaning head 16 to remain in contact with the roller 12 while traversing the roller 12.

While the invention has been described with particular reference to a preferred embodiment, it will be understood by those skilled in the art that various changes may be made and equivalents may be substituted without departing from the spirit of the invention.

Having described our invention in sufficient detail to enable those skilled in the art to make and use it, we claim and desire to secure Letters Patent of the United States for:

1. Apparatus for removing contaminants from a roller supporting photosensitive web material thereon inside a machine enclosure containing solvent vapor, the apparatus comprising:

a cleaning head having an absorbent material thereon;

means for moving the cleaning head lengthwise along the roller, said moving means comprising a skewed bearing arrangement and a smooth shaft mounted for rotation in said skewed bearing arrangement, said smooth shaft supporting the cleaning head;

means for selectively urging the cleaning head into contact with a predetermined location on the roller and retracting the cleaning head therefrom; and, means, external to the machine enclosure, for manually operably controlling both the moving means and the urging and retracting means.

2. The apparatus recited in claim 1 further comprising means for applying a cleaning solution to the cleaning head.

3. The apparatus of claim 1 wherein said absorbent material is a substantially lint-free cotton.

4. The apparatus recited in claim 3 wherein said limiting means is a pivot stop positionable in interference with the manually operable means for controlling the urging and retracting means.

5. An apparatus recited in claim 2 further comprising a cleaning housing for supporting said cleaning head, said cleaning housing having a channel for receiving and delivering said cleaning solution to said cleaning head.

6. An apparatus for removing contaminants from a roller supporting photosensitive web material thereon in a machine enclosure containing solvent vapor, comprising:

a substantially smooth first shaft mounted for rotation in said enclosure, said first shaft having a first end portion extending partially beyond the exterior of the enclosure, said first end portion comprising means for rotating the first shaft;

a second shaft positioned in said enclosure, said second shaft being substantially parallel to said first shaft and mounted for movement about said first shaft, and wherein said second shaft has a second end portion extending partially beyond the exterior of the enclosure, said second end portion comprising means for moving the second shaft about the first shaft; and, a cleaning housing slidably mounted to said first and second shafts, said cleaning housing comprising a cleaning head having an absorbent material thereon for contacting the roller and retracting therefrom under the influence of said second shaft, and wherein said cleaning housing slidably moves lengthwise along the roller upon rotation of said first shaft.

7. The apparatus recited in claim 6 further comprising means for applying a cleaning solution to the cleaning head.

8. The apparatus recited in claim 7 wherein a fluid channel having a fluid flow path is provided in said cleaning housing for receiving and delivering cleaning solution to the cleaning head.

9. The apparatus recited in claim 6 wherein said absorbent material is a substantially lint-free cotton.

10. The apparatus recited in claim 6 wherein the second end portion is mounted for rotation relative to the enclosure and the second end portion surrounds a and is concentric with the first end portion.

* * * * *